US010145033B2

(12) United States Patent
Baier et al.

(10) Patent No.: US 10,145,033 B2
(45) Date of Patent: Dec. 4, 2018

(54) CLEANING HEAD AND CLEANING DEVICE FOR CLEANING A SPINNING ROTOR ALONG WITH A METHOD FOR CLEANING A SPINNING ROTOR

(71) Applicant: Rieter Ingolstadt GmbH, Ingolstadt (DE)

(72) Inventors: Frank Baier, Geisenfeld (DE); Harald Widner, Ingolstadt (DE); Adalbert Stephan, Bellngries/Paulushofen (DE); Romeo Pohn, Geisenfeld/Rottenegg (DE)

(73) Assignee: Rieter Ingolstadt GmbH, Ingolstadt (DE)

( * ) Notice: Subject to any disclaimer, the term of this patent is extended or adjusted under 35 U.S.C. 154(b) by 140 days.

(21) Appl. No.: 15/015,662

(22) Filed: Feb. 4, 2016

(65) Prior Publication Data

US 2016/0230315 A1 Aug. 11, 2016

(30) Foreign Application Priority Data

Feb. 4, 2015 (DE) ..... 10 2015 101 590

(51) Int. Cl.
*D01H 4/24* (2006.01)

(52) U.S. Cl.
CPC ..... *D01H 4/24* (2013.01)

(58) Field of Classification Search
CPC ..... D01H 4/24
See application file for complete search history.

(56) References Cited

U.S. PATENT DOCUMENTS 3,869,851 A * 3/1975 Muller ..... D01H 4/24 57/301
4,125,991 A * 11/1978 Stahlecker ..... D01H 4/24 15/304
4,480,433 A 11/1984 Ryer, II
4,542,620 A * 9/1985 Kase ..... D01H 4/24 15/304
4,548,030 A 10/1985 Lauschke et al.
(Continued)

FOREIGN PATENT DOCUMENTS

DE 26 18 094 A1 11/1977
DE 211 587 A5 7/1984
(Continued)

OTHER PUBLICATIONS

German Patent Office Search Report, dated Nov. 25, 2015.

*Primary Examiner* — Shaun R Hurley
(74) *Attorney, Agent, or Firm* — Dority & Manning, P.A.

(57) ABSTRACT

A cleaning head of a cleaning device for cleaning a spinning rotor, by means of a feed device, be fed into a predetermined cleaning position in the interior of the spinning rotor. The cleaning head has a cleaning element formed as a scraper element arranged in such a manner that, in the predetermined cleaning position of the cleaning head, it is fed to the open edge of the spinning rotor. A cleaning device for cleaning a spinning rotor features a corresponding cleaning head. With a method for cleaning a spinning rotor by means of the cleaning device, after feed of the cleaning head into the cleaning position, the open edge of the spinning rotor is cleaned by means of the scraper element.

26 Claims, 3 Drawing Sheets

(56) References Cited

U.S. PATENT DOCUMENTS

| | | | | |
|---|---|---|---|---|
| 5,609,015 | A * | 3/1997 | Raasch | D01H 4/24 57/302 |
| 5,666,798 | A * | 9/1997 | Novotny | D01H 4/24 57/301 |
| 6,516,600 | B2 * | 2/2003 | Paweletz | D01H 4/24 57/302 |
| 6,748,732 | B2 | 6/2004 | Limmer | |
| 6,910,326 | B2 * | 6/2005 | Stephan | D01H 4/24 57/302 |
| 2002/0073685 | A1 * | 6/2002 | Paweletz | D01H 4/24 57/404 |
| 2003/0056846 | A1 | 3/2003 | Bahlmann et al. | |
| 2004/0079068 | A1 * | 4/2004 | Stephan | D01H 4/24 57/404 |

FOREIGN PATENT DOCUMENTS

| | | | |
|---|---|---|---|
| DE | 33 13 926 | A1 | 10/1984 |
| DE | 103 14 936 | A1 | 2/2004 |
| EP | 1 327 708 | A2 | 7/2003 |

* cited by examiner

CLEANING HEAD AND CLEANING DEVICE FOR CLEANING A SPINNING ROTOR ALONG WITH A METHOD FOR CLEANING A SPINNING ROTOR

FIELD OF THE INVENTION

The present invention relates to a cleaning head of a cleaning device for cleaning a spinning rotor featuring a fiber slide wall, a fiber collection groove and an open edge, wherein, by means of a feed device of the cleaning device, the cleaning head can be fed into a predetermined cleaning position in the interior of the spinning rotor. The cleaning head features at least one cleaning element formed as a scraper element. The invention also relates to a cleaning device with such a cleaning head and a method for cleaning a spinning rotor with the aid of a cleaning device.

BACKGROUND

During the operation of open-end spinning devices, upon their spinning, due to the constant contact of the fibers fed to the spinning rotor with the walls of the spinning rotor, and due to the fiber dust that arises, contaminants and deposits on the spinning rotor arise. This may impair the quality of the yarn that is spun, and therefore must be removed at regular intervals. Likewise, upon piecing after an interruption of the spinning process, for example after a yarn break, it is necessary to remove from it the fiber material that is still found in the spinning rotor, in order to ensure unvarying conditions regarding fiber quantity upon piecing and thus a uniform quality of the yarn that is spun. Therefore, various devices for rotor cleaning, which clean spinning rotors by means of mechanically contacting or pneumatic cleaning elements, are already known in the state of the art.

A cleaning head with a cleaning brush is known from U.S. Pat. No. 4,480,433. If such cleaning head is located in its working position fed to the spinning rotor, the bristles of the cleaning head engage in the rotor groove and free it from the contaminants adhering there by turning the brush head. However, with such cleaning devices provided with a brush, there is a risk that the detached contaminants will clog the bristles of the cleaning brush within a short time. Therefore, after a short time, the cleaning head must be replaced or even subjected to a cleaning.

By contrast, DE 26 18 094 A1 shows a cleaning head with a scraper element that is adjusted to the contour of the rotor groove and can be fed to the rotor groove. However, only the rotor groove itself can be cleaned by means of the scraper element. While the rotor groove of a spinning rotor is subjected, to a certain extent, to the depositing of dirt, contaminants may also arise in the area of the slide wall.

Therefore, EP 1 327 708 A2 proposes a cleaning device with a cleaning head, which cleans the rotor groove with a first cleaning element and the rotor slide wall with a second cleaning element. Thereby, a preferential embodiment of EP 1 327 708 A2 provides two groups of bristles, wherein a first group is to clean the rotor groove and a second group is to clean the side wall of the spinning rotor. In addition, one or two compressed air nozzles can be arranged, which support the cleaning of the rotor groove and/or the fiber slide wall, and further ensure the transporting away of the detached dirt.

However, it has been found that such contaminants arise not only in the area of the rotor groove and the fiber slide wall. Moreover, in the area directly at the open edge of the spinning rotor, over the course of time, such deposits (but those that are not picked up by conventional cleaning devices) arise. Such contaminants are suddenly and unexpectedly detached during the spinning process, or crumble and then fall into the fiber collection groove. This leads not only to quality impairments of the yarn that is drawn, but also quite frequently to yarn breaks. In particular, this problem arises in the processing of polyester fibers, since, due to the various chemical additives for spinning preparation, these particularly tend to produce deposits on the fiber slide wall of the spinning rotor.

SUMMARY OF THE INVENTION

A task of the present invention is to propose a cleaning head and a cleaning device and a method for cleaning a spinning rotor, which reliably eliminate the dirt of the spinning rotor in the area of the open edge of the spinning rotor. Additional objects and advantages of the invention will be set forth in part in the following description, or may be obvious from the description, or may be learned through practice of the invention.

The tasks are solved with the characteristics of the invention described herein.

A cleaning head of a cleaning device for cleaning a spinning rotor featuring a fiber slide wall, a fiber collection groove and an open edge can be fed by means of a feed device of the cleaning device into a predetermined cleaning position in the interior of the spinning rotor. The cleaning head features at least one cleaning element formed as a scraper element.

It is provided that the scraper element is arranged on the cleaning head in such a manner that, in the predetermined cleaning position of the cleaning head, it is fed to the open edge of the spinning rotor. Due to the arrangement of the scraper element on the cleaning head, as soon as the cleaning head is in its cleaning position, it can remove contaminants found directly on the open edge of the spinning rotor, which could not be picked up by conventional cleaning devices. Due to the design of the cleaning element as a scraper element, a particularly reliable removal of contaminants can take place. Particularly when processing polyester materials, which lead to very strong and stubborn deposits, a reliable cleaning can be carried out by means of the scraper element fed to the open edge of the spinning rotor. Thereby, it is also particularly advantageous that the cleaning can be carried out quite reliably over a long period, since it is only subject to low wear and cannot be clogged with contaminants, as with a cleaning brush.

With a cleaning device for cleaning a spinning rotor having a fiber slide wall, a fiber collection groove, and an open edge, the cleaning device features at least one cleaning head with at least one cleaning element along with a feed device for feeding the cleaning head into a predetermined cleaning position in the interior of the spinning rotor. The cleaning device has a corresponding cleaning head with a scraper element that can be fed to the open edge of the spinning rotor.

With a corresponding method for cleaning a spinning rotor by means of such a cleaning device, with which the cleaning head is fed by means of a feed device into a predetermined cleaning position in the interior of the spinning rotor, after the feed of the cleaning head into the cleaning position, the open edge of the spinning rotor is cleaned by means of a scraper element.

The cleaning of the open edge by the scraper element can be carried out with both a pushing movement and with a pulling movement. However, it is particularly advantageous if the cleaning of the open edge is carried out by the scraper element by means of a pushing movement.

With the method for cleaning a spinning rotor, it is also particularly advantageous if the cleaning of the open edge is carried out by the scraper element by means of a reversing movement. It has been found that a particularly good cleaning can take place in this manner, since, upon the actuation of the scraper element in only one direction, it may occur that the scraper element merely slides over the adhering dirt.

According to an advantageous embodiment of the cleaning device, this includes a drive unit for rotating the cleaning head. Advantageously, the drive unit is suitable for the reversing drive of the cleaning head.

According to an additional advantageous embodiment of the cleaning device, the cleaning head is arranged so on the cleaning device that it can be replaced. As such, it is possible to replace the cleaning head with the scraper element that can be fed to the open rotor edge with another cleaning head, for instance if a different material is to be spun.

With a cleaning head, it is also advantageous if the scraper element is, at least at its end turned towards the rotor in the cleaning position, made of a flexible material, in particular a flexible plastic material. In this case, it is also advantageous if the scraper element is arranged in a rigid manner at the cleaning head. Due to the deformability of the scraper element at least in its end area, it is nevertheless possible to feed the cleaning head with the scraper element projecting from it through the narrow passage of the rotor opening into the interior of the spinning rotor.

With a method for cleaning a spinning rotor, it is also advantageous if the cleaning head is fed with the scraper element through a combined rotation-forward movement into the interior of the spinning rotor, wherein the scraper element undergoes a temporary deformation. As such, the cleaning head with the scraper element projecting from it can also then be easily fed into the interior of the spinning rotor, if the dimensions of the cleaning head with the scraper element projecting from it exceed that of the rotor opening.

However, according to another design of the cleaning head, it is provided that the scraper element is arranged in a manner extendable at the cleaning head. This also enables the easy insertion of the cleaning head with the scraper into the spinning rotor.

With the cleaning head, it is also advantageous if the scraper element is mounted on the cleaning head in such a manner that, in the cleaning position of the cleaning head, a scraper edge of the scraper element is oriented at an angle of less than 20°, preferably at an angle of less than 15° and in particular preferentially at an angle of less than 5° or parallel to the fiber slide wall. It is thereby possible to, by means of a single cleaning head with a single scraper element, clean various spinning rotors with various fiber slide wall angles. Due to the feed of the scraper element directly at the open edge of the spinning rotor, even at low angular deviations, a sufficient effect of the scraper edge is still ensured.

According to an advantageous additional form of the invention, the scraper edge of the scraper element is formed by a beveled contour that is particularly adjusted to the spinning rotor to be cleaned, wherein the angle of the beveled contour with respect to the longitudinal extension of the scraper element is between 60° and 85°, preferentially between 70° and 80°. It has been found that a particularly stable scraper element can be obtained by such a shaping, which also shows a good effect for different spinning rotors with various slide wall angles.

For a particularly good cleaning effect, it is also advantageous if the scraper element is mounted to the cleaning head in such a manner that a scraper surface of the scraper element in its cleaning position, with the fiber slide wall of the spinning rotor in relation to the circumferential direction, encloses an angle of less than 75°, preferably of less than 60° and in particular preferentially of less than 50°. A scraper surface is understood to mean the surface that encloses the scraper edge and that defines the angle of attack of the scraper element in relation to the surface of the fiber slide wall. By means of an angle of less than 50°, a particularly good removal of contaminants is possible.

It is also advantageous if the scraper element is mounted on the cleaning head in such a manner that the scraper surface of the scraper element, with the fiber slide wall of the spinning rotor in relation to the circumferential direction, encloses an angle of greater than 15°, preferably of greater than 30° and in particular preferentially of greater than 40°. Particularly for a reversing cleaning of the spinning rotor by means of the scraper element, an angle of greater than 40° has proved to be advantageous.

According to an additional form of the invention, it is provided that the cleaning head features multiple scraper elements, which in the predetermined cleaning position of the cleaning head are fed to the open edge of the spinning rotor. Thereby, a particularly reliable removal of deposits can be carried out, wherein even stubbornly adhering dirt can be picked up by at least one of the multiple scraper elements.

In order to achieve a reliable cleaning of the entire spinning rotor, according to an additional form of the invention, it is provided that the cleaning head features an additional cleaning element, which is fed into the predetermined cleaning position of the fiber collection groove.

According to an advantageous additional form of the cleaning head, the additional cleaning element includes at least one scraper that is arranged in a manner preferably extendable on the cleaning head. By means of such a scraper, a particularly good removal of deposits from the area of the fiber collection groove can be achieved.

Alternatively or in addition to the cleaning element designed as a scraper, a compressed air nozzle may be provided as an additional cleaning element for cleaning the fiber collection groove.

According to an additional embodiment of the invention, the cleaning head may also feature an additional cleaning element, preferably also formed as a compressed air nozzle, which is fed to the fiber slide wall in the predetermined cleaning position of the cleaning head. It is thereby possible to clean all areas of the spinning rotor with a single cleaning head, such that the cleaning can be carried out in a particularly time-efficient manner.

With the method for cleaning a spinning rotor, after the feed of the cleaning head into the cleaning position, a pneumatic cleaning of the spinning rotor is advantageously carried out by at least one compressed air stream. Thereby, the at least one compressed air stream is preferably directed at the fiber collection groove of the spinning rotor. As described, this may take place in addition or alternatively to a mechanically contacting cleaning. In any case, however, the pneumatic cleaning of the spinning rotor by means of a compressed air stream has the advantage that the dirt detached by the scraper element at the open edge of the spinning rotor can also be transported away by the air stream.

With the pneumatic cleaning, it is advantageous if it is started prior to the feed or during the feed of the cleaning head into the cleaning position. Thereby, the at least one compressed air stream is directed at the open edge of the spinning rotor and/or the fiber slide wall of the spinning rotor. Thus, due to the feed movement with a single compressed air nozzle of the entire spinning rotor, it can be cleaned from the open edge through the fiber slide wall up to the fiber collection groove.

According to a particularly advantageous additional form of the invention, by means of the feed device, the cleaning head is thereby fed to the spinning rotor, initially in a docking position, and in the docking position a compressed air stream is directed at the open edge of the spinning rotor and/or the fiber slide wall of the spinning rotor. The feed into the cleaning position only takes place subsequent to this. By holding the cleaning head in the docking position, a sufficiently long duration of action of the compressed air stream is also achieved at the open edge of the spinning rotor or the fiber slide wall of the spinning rotor.

According to an additional embodiment of the invention, after the feed of the cleaning head into the cleaning position, a pneumatic cleaning of the spinning rotor is performed by means of an additional compressed air stream. The additional compressed air stream is directed at the fiber slide wall of the spinning rotor.

Furthermore, for inserting the cleaning head with the scraper element, particularly with a rigidly arranged scraper element, it is advantageous if it has an insertion chamfer.

In addition, it is advantageous if the cleaning head features a positioning device, in particular a positioning edge, for the scraper element. This can both facilitate the assembly in the correct position of the scraper element on the cleaning head, and act as anti-rotation protection for the scraper element, for example upon insertion into the spinning rotor for the feed movement.

BRIEF DESCRIPTION OF THE DRAWINGS

Additional advantages of the invention are described on the basis of the embodiments presented below. The following is shown.

DETAILED DESCRIPTION

Figure 1:
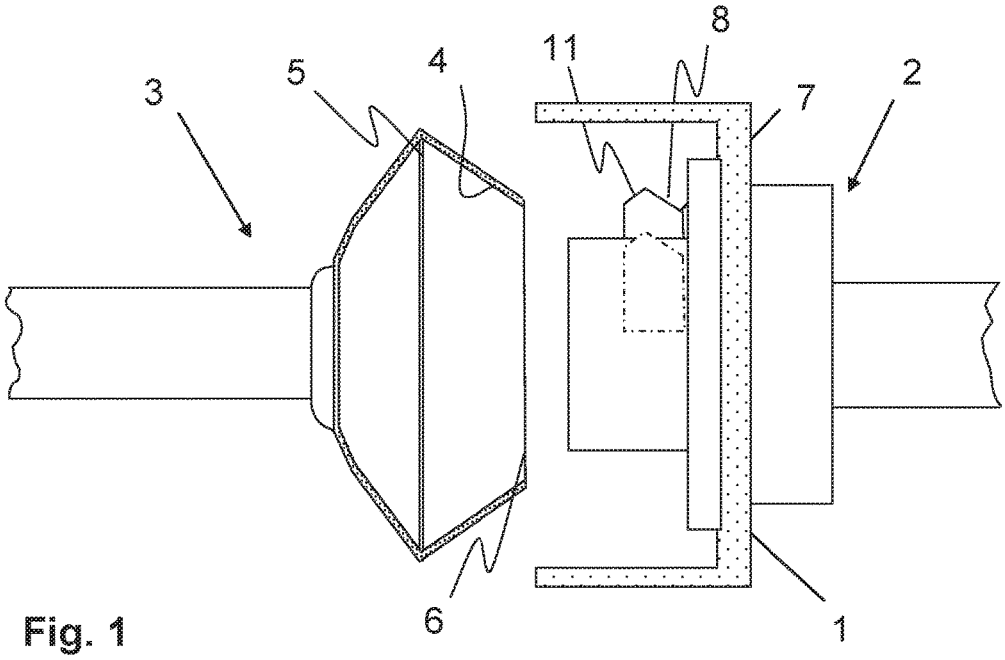
FIG. 1 is a cleaning head of a cleaning device and a spinning rotor in a partially sectional, schematic overview display.

Reference will now be made to embodiments of the invention, one or more examples of which are shown in the drawings. Each embodiment is provided by way of explanation of the invention, and not as a limitation of the invention. For example features illustrated or described as part of one embodiment can be combined with another embodiment to yield still another embodiment. It is intended that the present invention include these and other modifications and variations to the embodiments described herein.

FIG. 1 shows a spinning rotor 3 and a cleaning head 1 of a cleaning device 2 in a schematic, partially sectional overview display. In a conventional manner, the spinning rotor 3 features a fiber slide wall 4, a fiber collection groove 5 and an open edge 6. While, with conventional cleaning devices 2, emphasis has always been placed on a particularly good cleaning of the fiber collection groove 5 and the fiber slide wall 4, the cleaning of the open edge 6 of the spinning rotor 3 has not taken place, or has only taken place through a compressed air stream.

However, it has been found that it is frequently the case that significant deposits accumulate in the area of the open edge 6 of the spinning rotor 3. Due to the tolerances of the mounting position of the spinning rotor 3 in the spinning device, it must be ensured that, on the one hand, the fibers can be fed in all cases at the fiber slide wall, and, on the other hand, a sufficient distance for reaching the fiber collection groove 5 is still covered. Therefore, the feed must always be approximately 1 mm in distance from the open edge 6 of the spinning rotor 3, such that, because of the feeding, significant deposits always form on the same place on the open edge 6. This problem arises in particular with polyester fibers provided with a finishing agent.

According to the present invention, it is envisaged that the cleaning head 1 is provided with a cleaning element designed as a scraper element 7, which, when the cleaning head 1 is located in the cleaning position I (see FIG. 2), is precisely fed to the open edge 6 of the spinning rotor 3. Thereby, the cleaning head 1 is arranged in a cleaning device 2, which has a feed device (not shown here), in order to feed the cleaning head 1 into a predetermined cleaning position I (see FIG. 2) in the interior of the spinning rotor 3. Thereby, the scraper element 7 features a scraper edge 8, which cleans the open edge 6 of the spinning rotor 3. According to this figure, an insertion chamfer 11 is also arranged at the scraper element 7, in order to facilitate the insertion of the cleaning head 1 into the spinning rotor 3 in the cleaning position I.

Figure 2:
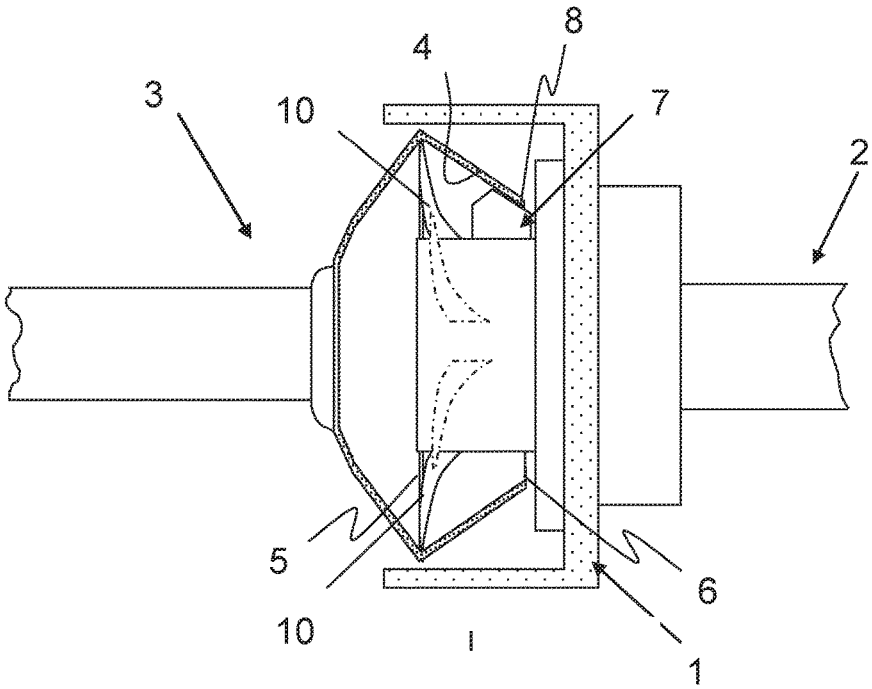
FIG. 2 is an additional variant of a cleaning head, which is fed to the spinning rotor in a cleaning position.
Figure 6:
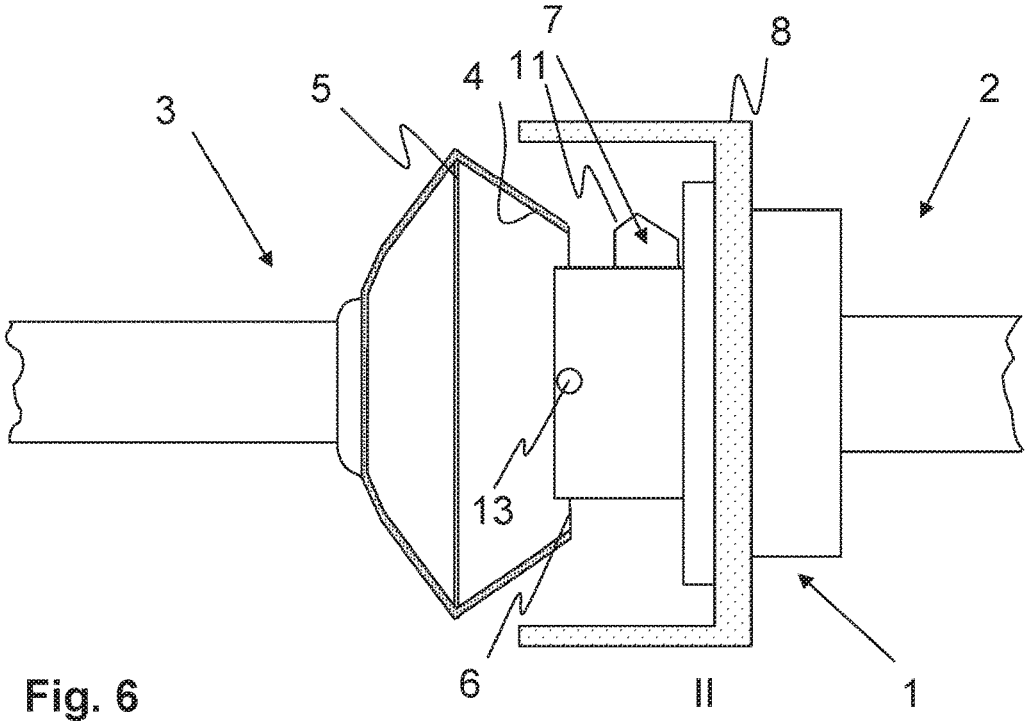
FIG. 6 is an additional design of a cleaning head in a docking position.
Figure 7:
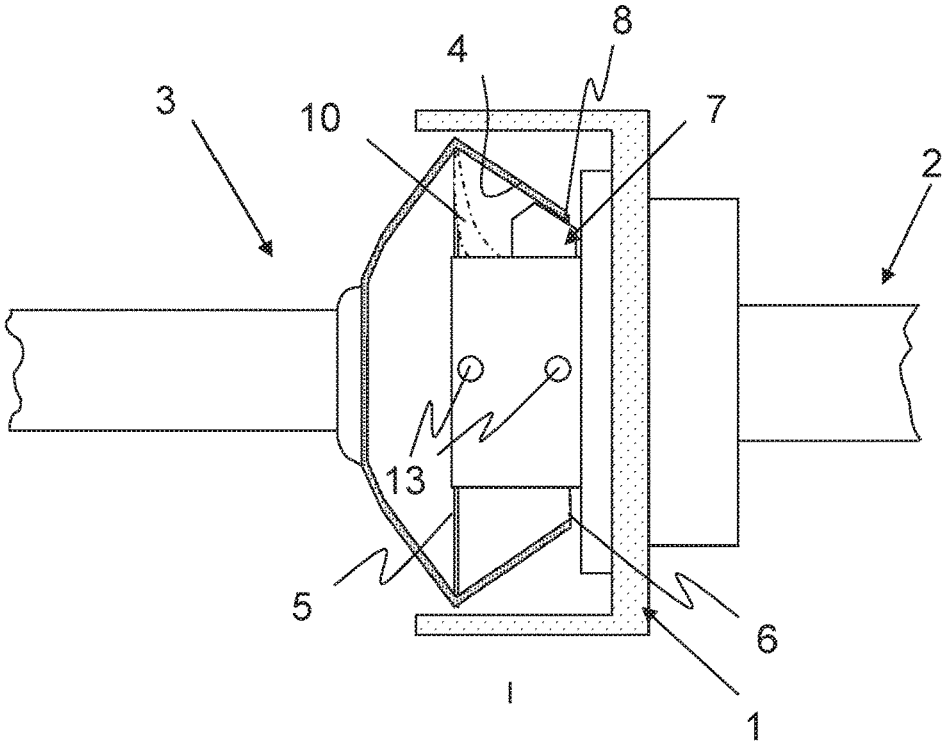
FIG. 7 is an additional design of a cleaning head in a cleaning position.

FIG. 2 shows a cleaning head 1 in its cleaning position I fed to the spinning rotor 3. It is thereby evident that the scraper edge 8 of the scraper element 7 is now precisely fed to the open edge 6 of the spinning rotor 3, and is thereby able to clean it. Thereby, the present cleaning head 1 advantageously features an additional cleaning element, which in the present case is formed by two extendable scrapers 10. These are fed into the cleaning position I of the cleaning head 1 of the fiber collection groove 5, in order to enable a reliable cleaning of the spinning rotor 3 there. The additional cleaning element, which in the present case is designed as a scraper 10, may be also designed in another manner, for example as a cleaning brush or a compressed air nozzle 13. For example, FIGS. 6 and 7 show additional designs of a cleaning head 1, in which, for cleaning the open edge 6 of the spinning rotor 3, the scraper element 7 is combined with several compressed air nozzles 13.

Figure 3:
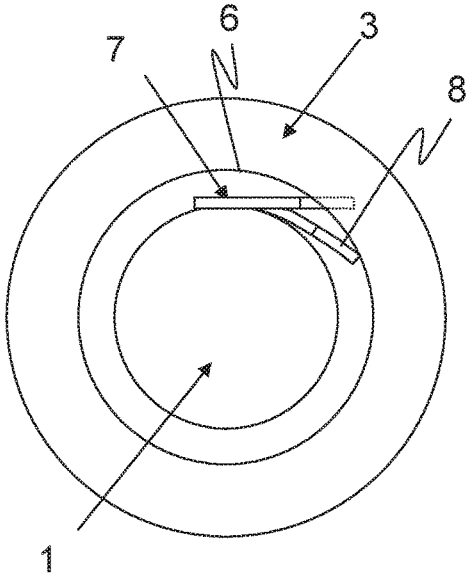
FIG. 3 is a schematic top view of the opening of a spinning rotor with a cleaning head located therein.

FIG. 3 shows a schematic top view of the opening of a spinning rotor 3 with a schematically shown cleaning head 1 that is found therein, with a scraper element 7 arranged thereon. According to this figure, the scraper element 7 is made of a limited flexible material, for example a plastic material. On the one hand, this imparts upon the scraper element 7 the necessary rigidity to scrape off contaminants from the open edge 6 of the spinning rotor 3, but on the other hand enables the dropping away of the scraper element 7 upon the insertion of the cleaning head 1 into the spinning rotor 3. This makes it possible to insert the cleaning head 1 into the spinning rotor 3 by means of a rotational movement, in particular a combined rotation-forward movement, wherein the scraper element 7 drops away upon contact with the open edge 6 of the spinning rotor 3 and is pressed against the cleaning head 1. If the cleaning head 1 is then set in the cleaning position I (see also FIG. 4), due to its flexibility and elasticity, the scraper element 7 falls back to its original position and makes contact with the edge 6 of the spinning rotor 3 to be cleaned. Thereby, in a structurally simple manner, it is possible to arrange the scraper element 7 rigidly on the cleaning head 1. In doing so, a complicated mechanism for extending the scraper element 7 or for feeding the scraper element 7 at the open edge 6 is not required.

Figure 4:
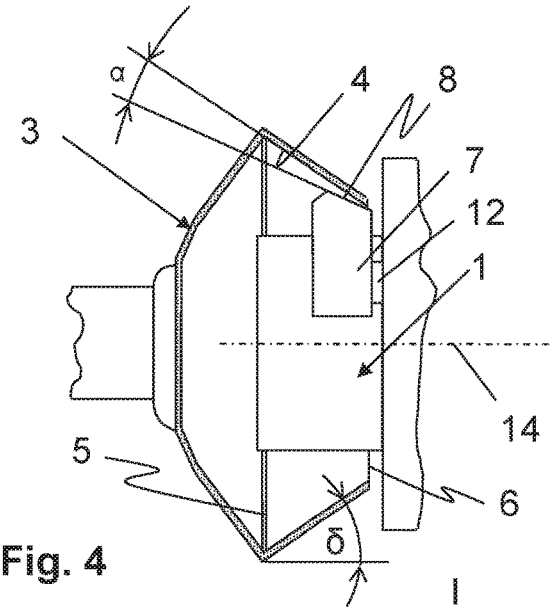
FIG. 4 is a detailed view of a cleaning head with a scraper element in a cleaning position.

FIG. 4 in turn shows a cleaning head 1 with a scraper element 7 in the cleaning position I fed to the spinning rotor 3. The scraper element 7 is mounted on the cleaning head 1 in such a manner that, in the cleaning position, it is particularly preferentially oriented in a manner parallel to the fiber slide wall 4. However, it is also possible and advantageous if the scraper edge 8 of the scraper element 7 is oriented at an angle $\alpha$ of less than 20° with the fiber slide wall 4 of the spinning rotor 3. In doing so, it is also possible to clean various spinning rotors 3 with various slide wall angles with a single cleaning head 1 or with a single scraper element 7. Conventional spinning rotors feature, for example, a sliding wall angle $\delta$ of between 10° and 25°. As such, the scraper edge 8 of the scraper element 7 is preferentially designed as a beveled contour, which, in its angle $\gamma$ (see FIG. 8), is adjusted to the slide wall angle $\delta$ of the spinning rotor 3 to be cleaned.

Figure 8:
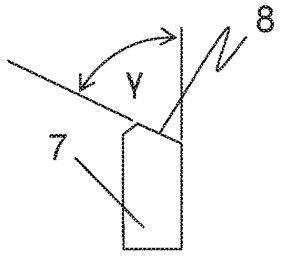
FIG. 8 is a detailed view of a scraper element 7.

FIG. 8 shows a schematic view of a scraper element 7 with such a scraper edge 8 formed by a beveled contour. The angle $\gamma$ of the scraper edge 8 or the beveled contour of the scraper element 7 is designed, as the case may be, with respect to the longitudinal extension of the scraper element 7, for adjustment to the sliding wall angle $\delta$ of the spinning rotors 3, which is between 10° and 25°. Preferentially, the angle $\gamma$ with respect to the longitudinal extension of the scraper element 7 is between 60° and 85°, in particular preferentially between 70° and 80°, in order to achieve the best possible cleaning effect with the various spinning rotors 3 with various slide wall angles $\delta$.

As also shown in FIG. 4, that scraper element 7 is arranged, in relation to its longitudinal extension, preferentially perpendicular to a longitudinal axis 14 of the cleaning head 1. However, it is also possible to form the scraper element 7 in a different manner and a different shaping, or arrange it in a manner oblique to the cleaning head 1. Thereby, it is only essential that, due to the arrangement and the shape of the scraper edge 8 of the scraper element 7, the open edge 6 can be easily achieved with various spinning rotors 3.

According to the design of FIG. 4, a positioning device 12 is still provided on the cleaning head 1. This may be formed as, for example, a positioning edge, a projection or even several projections, and supports the scraper element 7 in such a manner that, upon insertion into the spinning rotor 3, even during a contact with the open edge 6 of the spinning rotor 3, it is not pressed from its position.

Figure 5:
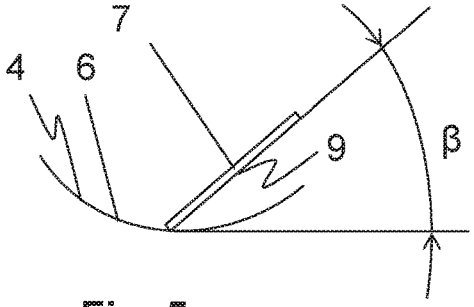
FIG. 5 is a schematic view of a scraper element fed to the fiber slide wall of a spinning rotor.

FIG. 5 shows a schematic view of a scraper element 7 fed to the open edge 6 of a spinning rotor 3. For the best possible cleaning effect, it is thereby advantageous if a scraper surface 9 of the scraper element 7, in the cleaning position with the fiber slide wall 4 or with the open edge 6 of the spinning rotor 3, as the case may be, encloses an angle $\beta$ of between 15° and 75°. In a particularly advantageous manner, by means of such angle $\beta$ between the scraper element 7 and the fiber slide wall 4, it is also possible to clean the spinning rotor 3 by means of a reversing movement. Likewise, however, the cleaning of the spinning rotor 3 can be carried out with a purely pushing movement or a purely pulling movement. For this purpose, the cleaning head 1 includes a drive unit for rotating the cleaning head 1 in one or in both directions of rotation.

FIG. 6 shows an additional design of a cleaning head 1, with which, in addition to the scraper element 7 for cleaning the open edge 6 of the spinning rotor 3, an additional cleaning element for cleaning the fiber collection groove 5 is provided. In the present case, the additional cleaning element is designed as a compressed air nozzle 13. Thereby, the compressed air nozzle 13 is arranged in such a manner that, with the cleaning head 1 located in the cleaning position I, it is fed to the fiber collection groove 5.

In the present case of FIG. 6, the cleaning head 1 is shown in a docking position II, in which it is centered just opposite from the spinning rotor 3 to be cleaned and contacts this by means of docking elements, which are not shown. As the figure shows, in this docking position II, the compressed air nozzle 13, which is provided for cleaning the fiber collection groove 5, is in a position in which it is at a level with the open edge 6 of the spinning rotor 3. It is now provided that the pneumatic cleaning is started by means of one or more compressed air nozzles 13, already in the docking position II of the cleaning head 1. As a result, a first advantageous cleaning the fiber slide wall 4 is achieved, while the cleaning head 1 is driven from the docking position II into the cleaning position I of FIG. 7. Depending on the arrangement of the compressed air nozzle 13, the open edge 6 of the spinning rotor 3 is thereby subjected to the cleaning. Thereby, it is particularly advantageous if the cleaning head 1 is held in the docking position II for a predetermined period of time and, during this predetermined period of time, the compressed air nozzle 13 is subjected to compressed air. Thereby, a particularly good and intensive cleaning of the fiber slide wall 4 can take place. Thereby, it may also be provided, for example, that the cleaning head 1 is moved in steps from the docking position II into the cleaning position I, in order to perform, after each step, a pneumatic cleaning for a predetermined period of time.

FIG. 7 shows an additional design of a cleaning head 1, with which, in addition to the scraper element 7, two compressed air nozzles 13 are arranged on the cleaning head 1. In the cleaning position I shown here, the open edge 6 of the spinning rotor 3 is finally cleaned by means of the scraper element 7, under the rotation of the cleaning head 1, while the fiber collection groove 5 is cleaned by means of a compressed air stream through the compressed air nozzle 13. It is also possible here to, despite the cleaning of the fiber collection groove 5 by the compressed air nozzle 13, optionally provide an additional scraper 10 for cleaning the fiber collection groove 5, as indicated here by the dashed figure. Finally, in the present case, an additional compressed air nozzle 13 is provided, by means of which, in the cleaning position I, an additional compressed air stream is directed at the fiber slide wall 4 of the spinning rotor 3. Moreover, with this design, it is, as described in FIG. 6, clearly possible to initially take the cleaning head 1 into the docking position II, and start the pneumatic cleaning by means of at least the front compressed air nozzle 13 turned towards the spinning rotor 3, already in the docking position II.

By means of the described cleaning head 1 with a scraper element 7 for cleaning the open edge 6 of the spinning rotor 3, with this invention, it is possible to clean the open edge 6 of the spinning rotor 3 such that a build-up and subsequent detachment of contaminants during the spinning process is avoided. This can both improve the yarn quality and piecing quality, and reduce the number of yarn breaks caused by such detaching deposits.

The invention is not limited to the embodiments shown. It is also possible to, for example, design a scraper element 7 without an insertion chamfer 11 and to arrange this on the cleaning head 1 in a manner that is not rigid, but movable (for example, extendable from the cleaning head as depicted by the dashed and solid line positions of the scraper elements 7 in FIGS. 1 and 2). Likewise, in addition to the scraper element 7, various other cleaning elements such as compressed air nozzles 13 and scrapers 10, in various combinations, can be arranged on the cleaning head 1. Thereby, it is also possible to arrange two or more scraper elements 7 in a circumferential direction, offset to the cleaning head 1. Thereby, a particularly good cleaning can be achieved, since, based on the partial flexibility of the scraper element 7, under certain circumstances, a repeated driving over of deposits is necessary, in order to detach them from the fiber slide wall 4 or the open edge 6 of the spinning rotor 3, as the case may be.

Modifications and variations can be made to the embodiments illustrated or described herein without departing from the scope and spirit of the invention as set forth in the appended claims.

LIST OF REFERENCE SIGNS

1 Cleaning head
2 Cleaning device
3 Spinning rotor
4 Fiber slide wall
5 Fiber collection groove
6 Open edge
7 Scraper element
8 Scraper edge
9 Scraper surface
10 Scraper
11 Insertion chamfer
12 Positioning device
13 Compressed air nozzle
14 Longitudinal axis
I Cleaning position
II Docking position
α Angle between scraper edge and fiber slide wall
β Angle between scraper surface and fiber slide wall
γ Angle between the beveled contour and the longitudinal extension of the scraper element
δ Slide wall angle

The invention claimed is:

1. A cleaning head for a cleaning device used to clean a spinning rotor that has a fiber slide wall, a fiber collection groove, and an open edge at an uppermost portion of the fiber slide wall, wherein the cleaning device has a feed device that feeds the cleaning head into a fixed predetermined cleaning position in an interior of the spinning rotor, the cleaning head comprising:

a cleaning element formed as a scraper element comprising a unitary member with a continuous elongated scraper edge at an end thereof turned towards the spinning rotor, the unitary member oriented on the cleaning head such that the scraper edge extends longitudinally into the spinning rotor transverse to the fiber collection groove; and the scraper element arranged on the cleaning head at a location such that, in the fixed predetermined cleaning position of the cleaning head with the cleaning head in the interior of the spinning rotor, the scraper edge is disposed longitudinally against the fiber slide wall and extends to or partially outward from the interior of the spinning rotor past the open edge of the spinning rotor for cleaning the open edge of the spinning rotor.

2. The cleaning head according to claim 1, wherein the scraper element is made of a flexible material at least at the scraper edge.

3. The cleaning head according to claim 1, wherein the scraper element is mounted on the cleaning head so as to be extendable from the cleaning head.

4. The cleaning head according to claim 1, wherein the scraper edge is oriented at an angle (α) of less than 20° relative to the fiber slide wall.

5. The cleaning head according to claim 1, wherein the scraper edge defines an angle (γ) with respect to a longitudinal extension of the scraper element between 60° and 85°.

6. The cleaning head according claim 1, wherein the scraper element comprises a scraper surface, the scraper element mounted on the cleaning head such that the scraper surface in the cleaning position of the cleaning head encloses an angle (β) relative to the fiber slide wall of less than 75°.

7. The cleaning head according to claim 6, wherein the angle (β) is greater than 15°.

8. The cleaning head according to claim 1, comprising multiple ones of the scraper elements that are fed to the open edge of the spinning rotor in the fixed predetermined cleaning position of the cleaning head.

9. The cleaning head according to claim 1, further comprising a first additional cleaning element that is fed to the fiber collection groove of the spinning rotor in the fixed predetermined cleaning position of the cleaning head.

10. The cleaning head according to claim 9, wherein the first additional cleaning element comprises a scraper that extends from the cleaning head.

11. The cleaning head according to claim 9, wherein the first additional cleaning element comprises a compressed air nozzle.

12. The cleaning head according to claim 9, further comprising a second additional cleaning element that is fed to the fiber slide wall in the fixed predetermined cleaning position of the cleaning head.

13. The cleaning head according to claim 1, wherein the scraper element comprises an insertion chamfer.

14. The cleaning head according to claim 1, further comprising a positioning device configured with the scraper element that, in the fixed predetermined cleaning position of the cleaning head, ensures the scraper edge is disposed at the open edge of the spinning rotor.

15. A cleaning head for a cleaning device used to clean a spinning rotor that has a fiber slide wall, a fiber collection groove, and an open edge at an uppermost portion of the fiber slide wall, wherein the cleaning device has a feed device that feeds the cleaning head into a fixed predetermined cleaning position in an interior of the spinning rotor, the cleaning head comprising:

a cleaning element formed as a scraper element;

the scraper element arranged on the cleaning head at a location such that, in the fixed predetermined cleaning position of the cleaning head in the interior of the spinning rotor, the scraper element is disposed against and extends to or partially outward from the interior of the spinning rotor past the open edge of the spinning rotor for cleaning the open edge of the spinning rotor; and wherein the scraper element comprises a scraper edge formed by a beveled contour.

16. A cleaning device for cleaning a spinning rotor that has a fiber slide wall, a fiber collection groove, and an open edge at an uppermost portion of the fiber slide wall, the cleaning device comprising:

a cleaning head;

a feed device that feeds the cleaning head into a fixed predetermined cleaning position in an interior of the spinning rotor;

the cleaning head comprising a cleaning element formed as a scraper element comprising a unitary member with a continuous elongated scraper edge at an end thereof turned towards the spinning rotor, the unitary member oriented on the cleaning head such that the scraper edge extends longitudinally into the spinning rotor transverse to the fiber collection groove; and the scraper element arranged on the cleaning head at a location such that, in the fixed predetermined cleaning position of the cleaning head within the interior of the spinning rotor, the scraper edge is disposed longitudinally against the fiber slide will and extends to or partially outward from the interior of the spinning rotor past the open edge of the spinning rotor for cleaning the open edge of the spinning rotor.

17. The cleaning device according to claim 16, further comprising a drive unit for rotating the cleaning head.

18. The cleaning device according to claim 16, wherein the cleaning head is a replaceable element on the cleaning device.

19. A method for cleaning a spinning rotor having a fiber slide wall, a fiber collection groove, and an open edge at an uppermost portion of the fiber slide wall, the method comprising:

feeding a cleaning device having a cleaning head into a fixed predetermined cleaning position in the interior of the spinning rotor, the cleaning head having a cleaning element defined as a scraper element comprising a unitary member with a continuous elongated scraper edge at an end thereof turned towards the spinning rotor, the unitary member oriented on the cleaning head such that the scraper edge extends longitudinally into the spinning rotor transverse to the fiber collection groove, wherein at the fixed predetermined cleaning position with the cleaning head within the interior of the spinning rotor, the scraper edge is disposed longitudinally against the fiber slide wall and extends to or partially outward from the interior of the spinning rotor beyond the open edge; and at the fixed predetermined cleaning position, cleaning the open edge of the spinning rotor with the scraper element.

20. The method according to claim 19, wherein the open edge is cleaned with a pushing movement of the scraper element.

21. The method according to claim 19, wherein the open edge is cleaned by a reversing movement of the scraper element.

22. The method according to claim 19, wherein the cleaning head is fed with the scraper element through a combined rotation-forward movement into the interior of the spinning rotor, wherein the scraper element undergoes a temporary deformation.

23. A method for cleaning a spinning rotor having a fiber slide wall, a fiber collection groove, and an open edge at an uppermost portion of the fiber slide wall, the method comprising:

feeding a cleaning device having a cleaning head into a fixed predetermined cleaning position in the interior of the spinning rotor, the cleaning head having a cleaning element defined as a scraper element, wherein at the fixed predetermined cleaning position, the scraper element is disposed against the open edge and extends to or partially outward from the interior of the spinning rotor beyond the open edge;

at the fixed predetermined cleaning position, cleaning the open edge of the spinning rotor with the scraper element; and wherein at the fixed predetermined cleaning position of the cleaning head, the spinning rotor is also pneumatically cleaned with a first compressed air stream.

24. The method according to claim 23, wherein the pneumatic cleaning is started prior to or during feed of the cleaning head to the fixed predetermined cleaning position such that the first compressed air stream is directed at the open edge of the spinning rotor or the fiber slide wall of the spinning rotor as the cleaning head moves to the fixed predetermined cleaning position.

25. The method according to claim 23, wherein the cleaning head is initially fed to a docking position where the first compressed air stream is directed at the open edge of the spinning rotor or the fiber slide wall of the spinning rotor prior to feeding the cleaning head to the fixed predetermined cleaning position.

26. The method according to claim 23, wherein the first compressed air stream is directed at the fiber collection groove, and further comprising directing a second compressed air stream from the cleaning head to the fiber slide wall of the spinning rotor at the fixed predetermined cleaning position.

* * * * *